US010189269B2

(12) United States Patent
Yasuda et al.

(10) Patent No.: US 10,189,269 B2
(45) Date of Patent: Jan. 29, 2019

(54) RECORDING APPARATUS AND RECORDING METHOD

(71) Applicant: CANON KABUSHIKI KAISHA, Tokyo (JP)

(72) Inventors: Ayumi Yasuda, Yokohama (JP); Junichi Saito, Kawasaki (JP); Noboru Kunimine, Tokyo (JP); Takumi Kaneko, Tokyo (JP); Rie Takekoshi, Kawasaki (JP); Takayuki Ushiyama, Kawasaki (JP); Tatsuo Shimmoto, Tokyo (JP); Keita Ishimi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/721,418

(22) Filed: Sep. 29, 2017

(65) Prior Publication Data

US 2018/0104961 A1 Apr. 19, 2018

(30) Foreign Application Priority Data

Oct. 19, 2016 (JP) ..... 2016-205383

(51) Int. Cl.
*B41J 2/21* (2006.01)
*B41J 2/045* (2006.01)

(52) U.S. Cl.
CPC ..... *B41J 2/2103* (2013.01); *B41J 2/04508* (2013.01); *B41J 2/04586* (2013.01); *B41J 2/2132* (2013.01)

(58) Field of Classification Search
CPC .. B41J 2/2103; B41J 2/04508; B41J 2/04586; B41J 2/2132
See application file for complete search history.

(56) References Cited

U.S. PATENT DOCUMENTS 5,568,169 A * 10/1996 Dudek ..... B41J 2/2107 347/15
8,721,021 B2 * 5/2014 Nakajima ..... B41J 19/142 347/15

FOREIGN PATENT DOCUMENTS

JP 2002-113850 A 4/2002

* cited by examiner

*Primary Examiner* — Thinh H Nguyen
(74) *Attorney, Agent, or Firm* — Canon U.S.A., Inc. IP Division

(57) ABSTRACT

A recording apparatus discharges both high-permeability black ink and low-permeability black ink to a boundary between a color area and a black area.

20 Claims, 14 Drawing Sheets

M_K2a

M_K1

M_K2b

N_K2a

N_K1

N_K2b

FORWARD SCANNING OPERATION

BACKWARD SCANNING OPERATION

RECORDING APPARATUS AND RECORDING METHOD

BACKGROUND OF THE INVENTION

Field of the Invention

The aspect of the embodiments relates to a recording apparatus and a recording method.

Description of the Related Art

A known recording apparatus is, in particular, the one having a recording head for discharging ink of a plurality of colors records an image by discharging ink from the recording head to a recording medium. Such a recording apparatus is generally known to use not only what is called color ink, such as cyan, magenta, and yellow ink, but also black ink as ink of a plurality of colors.

From the viewpoint of coloring uniformity, the color ink is to have relatively high permeability over a recording medium. From the viewpoint of color density and thin line quality, on the other hand, the black ink is to have low permeability over a recording medium. However, using the color ink having high permeability and the black ink having low permeability may possibly cause black ink blur at the boundary between an area where an image is recorded with the black ink (hereinafter referred to as a black area) and an area where an image is recorded with the color ink (hereinafter referred to as a color area) on a recording medium. Generally, lower permeability brings a higher surface tension. When liquids having different surface tensions contact each other, the following phenomenon occurs: a liquid having a higher surface tension bleeds into a liquid having a lower surface tension. The black ink bleeding into the color ink resulting from this phenomenon causes the above-described black ink blur.

Japanese Patent Application Laid-Open No. 2002-113850 discusses a technique for using two different types of black ink (black ink having high permeability and black ink having low permeability) for the above-described black ink blur. More specifically, the technique discussed in Japanese Patent Application Laid-Open No. 2002-113850 records an image not by discharging the black ink having low permeability (a high surface tension) but by discharging the black ink having high permeability (a low surface tension) to the boundary between a black area and a color area. According to the description of Japanese Patent Application Laid-Open No. 2002-113850, the technique prevents the black ink bleeding into the color area so that an image with a less amount of black ink blur can be recorded.

However, ink having a low surface tension is likely to split into a large ink droplet (also referred to as a main droplet) and small ink droplets (also referred to as satellites) when discharged. Since satellites are lighter than the main droplet, satellites are strongly affected by an air current occurring at the time of ink discharge, and hence are likely to produce a landing position deviation on the recording medium.

The technique discussed in Japanese Patent Application Laid-Open No. 2002-113850 uses only ink having high permeability (a low surface tension) on the boundary between a black area and a color area. Therefore, the discharge amount of ink having high permeability (a low surface tension) on the boundary increases and a large number of satellites occur. Accordingly, a large number of satellites of the black ink may land on the color area because of the effect of the above-described landing position deviation. As a result, the boundary between the color area and the black area may possibly become ambiguous.

SUMMARY OF THE INVENTION

According to an aspect of the embodiments, a recording apparatus a recording head configured to discharge first black ink, second black ink having a higher surface tension than the first black ink, and color ink having a lower surface tension than the second black ink, a determination unit configured to determine whether a target portion of a first area to be subjected to recording with a black color on a recording medium is an edge portion adjoining a second area to be subjected to recording with at least the color ink, and a control unit configured to control a recording operation to record an image on the recording medium by discharging ink from the recording head, wherein the control unit controls the recording operation to discharge both the first and the second black ink to the target portion determined to be the edge portion.

Further features of the disclosure will become apparent from the following description of exemplary embodiments with reference to the attached drawings.

DESCRIPTION OF THE EMBODIMENTS

An exemplary embodiment of the disclosure will be described in detail below with reference to the accompanying drawings.

Figure 1:
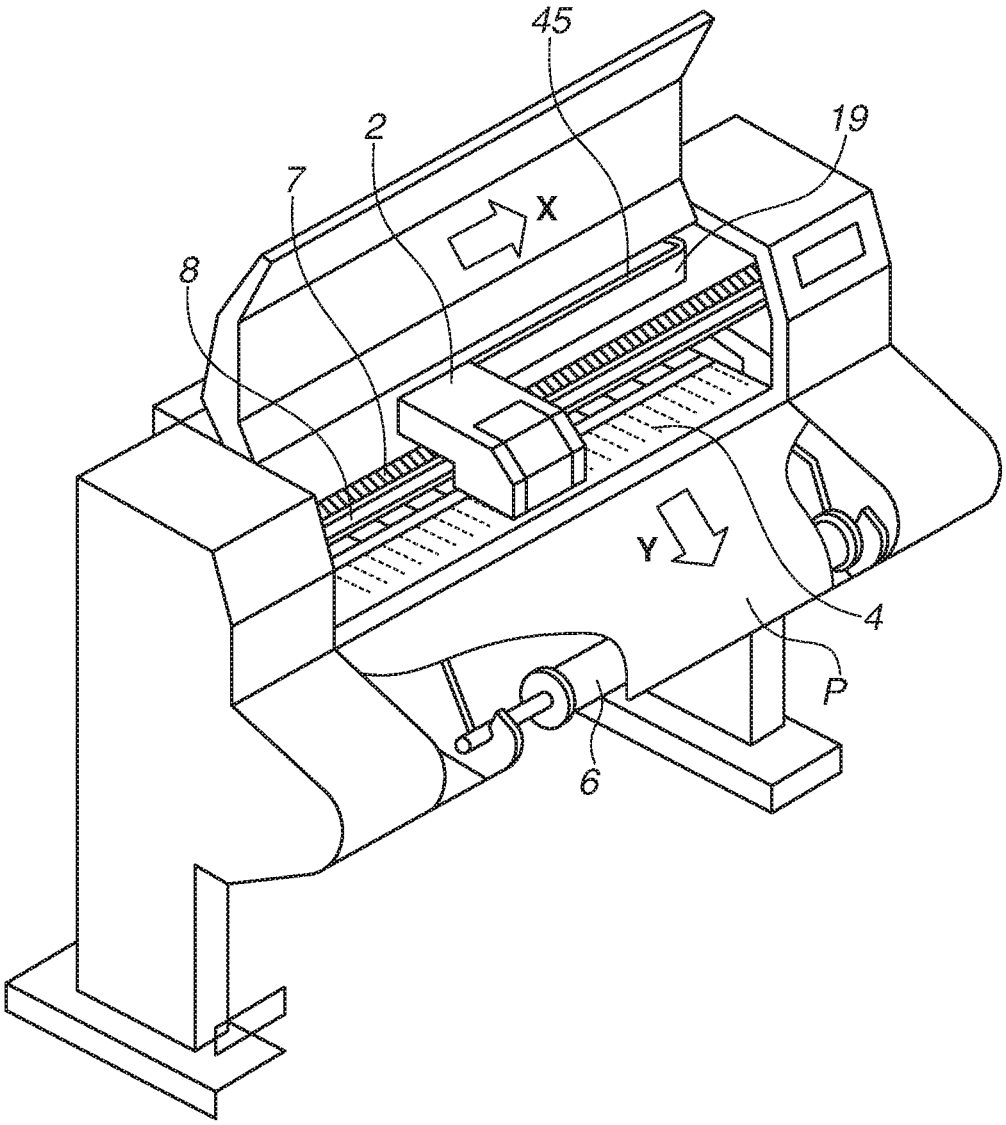
FIG. 1 is a perspective view illustrating a recording apparatus according to an exemplary embodiment.

FIG. 1 illustrates an outer appearance of an ink-jet recording apparatus (also referred to as a recording apparatus or printer) according to the present exemplary embodiment. This printer is what is called a serial scan type printer which reciprocally moves a recording head for scanning in the X direction (scanning direction) perpendicularly intersecting with the Y direction (conveyance direction) of a recording medium P to record an image on the recording medium P.

A configuration and an outline of a recording operation of the ink-jet recording apparatus will be described below with reference to FIG. 1. The recording medium P is conveyed in the Y direction by a spool 6. The spool 6 holds the recording medium P with a conveyance roller driven by a conveyance motor (not illustrated) via a gear. Meanwhile, at a predetermined conveyance position, a carriage unit 2 is reciprocally moved for scanning along with a guide shaft 8 extending in the X direction by a carriage motor (not illustrated). In this scanning process, a discharge operation is performed from the discharge port of a recording head (described below) attachable to the carriage unit 2 at a timing based on a position signal acquired by an encoder 7, thus recording is performed for a fixed bandwidth corresponding to the range of a discharge port array. The ink-jet recording apparatus according to the present exemplary embodiment is configured to move the recording head for scanning with a scanning speed of 40 inches per second, and perform a discharge operation with a resolution of 600 dot per inch (dpi) or 1/600 inches. Subsequently, the ink-jet recording apparatus conveys the recording medium P and performs recording for the following bandwidth. The ink-jet recording apparatus is also capable of moving the recording head at a speed higher than 40 inches per second.

A carriage belt can be used to transfer a driving force from the carriage motor to the carriage unit 2. However, other drive systems are also applicable. For example, an applicable drive system includes, instead of the carriage belt, a lead screw which is rotatably driven by the carriage motor and extends in the X direction, and an engagement portion which is provided in the carriage unit 2 and engages with the groove of the lead screw.

The fed recording medium P is nipped and conveyed by a feed roller and a pinch roller and then guided to a recording position (a main scan area of the recording head) on a platen 4. Normally in a nonoperating state, since a cap is applied to the face side of the recording head, the cap is opened before recording to allow the recording head or the carriage unit 2 to move for scanning. Subsequently, when data for one scan has been accumulated in a buffer, the carriage motor causes the carriage unit 2 to scan to perform recording as described above.

The recording apparatus according to the present exemplary embodiment can perform what is called multipass recording in which an image is recorded in a unit area (1/n band) on the recording medium P through a plurality of scans (n scans) by the recording head. When performing this multipass record, the recording apparatus performs paper feed by around 1/n band for each scan and then performs scanning again. Thus, an image can be completed through a plurality of scans (n scans) by using different discharge ports related to recording on a unit area on the recording medium P.

Figure 2:
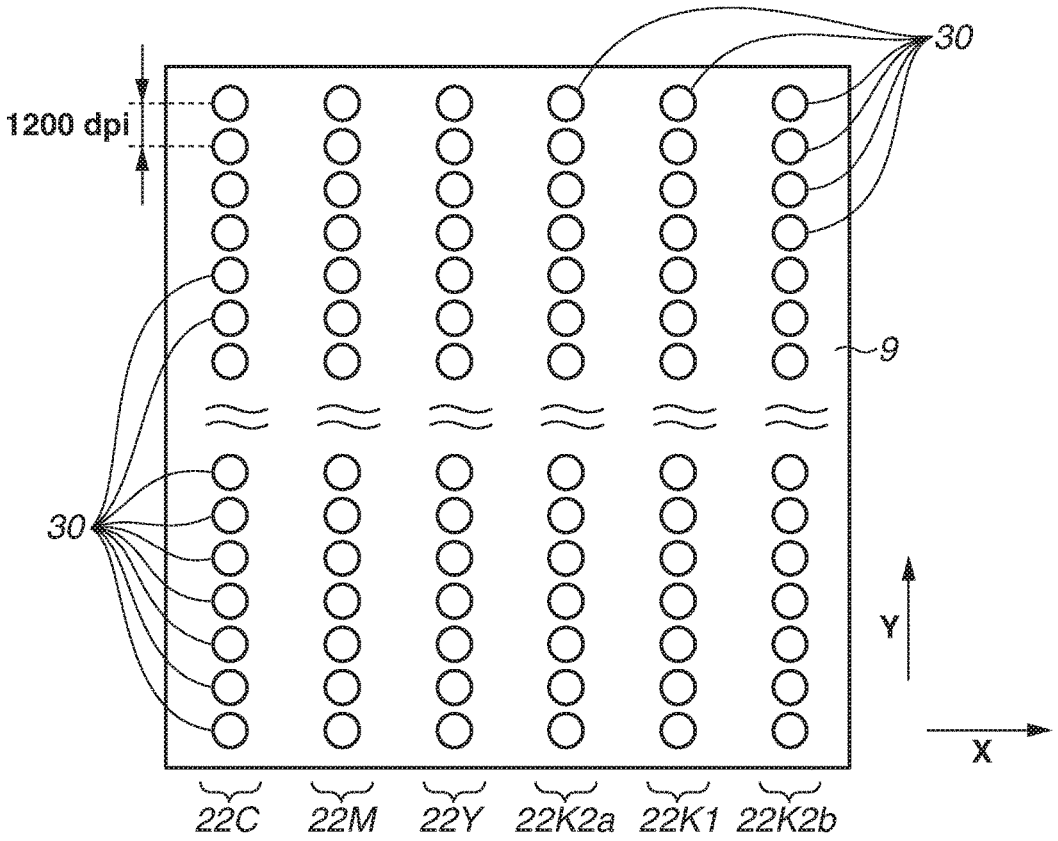
FIG. 2 is a schematic view illustrating a recording head according to an exemplary embodiment.

FIG. 2 illustrates a recording head 9 according to the present exemplary embodiment. The recording head 9 is provided with a discharge port array 22C for discharging cyan ink (C), a discharge port array 22M for discharging magenta ink (M), and a discharge port array 22Y for discharging yellow ink (Y), which are all chromatic color ink. The recording head 9 is further provided with a discharge port array 22K2*a* for discharging low-permeability black ink (K2), a discharge port array 22K1 for discharging high-permeability black ink (K1), and a discharge port array 22K2*b* for discharging low-permeability black ink (K2), which are all achromatic color ink. The recording head 9 is composed of the discharge port arrays 22C, 22M, 22Y, 22K2*a*, 22K1, and 22K2*b* in this order from left to right in the X direction.

The low-permeability black ink (K2) discharged from the discharge port arrays 22K2*a* and 22K2*b* is of the same type. The high-permeability black ink (K1) and the low-permeability black ink (K2) have similar colors having almost the same hue. The low-permeability black ink (K2) has a higher surface tension than that of the high-permeability black ink (K1).

Each of the discharge port arrays 22C, 22M, 22Y, 22K2*a*, 22K1, and 22K2*b* is composed of 1280 discharge ports 30, for discharging ink, disposed in the Y direction (array direction) with a density of 1200 dpi. One discharge port 30 according to the present exemplary embodiment discharges an ink amount of about 4.5 pico liter (pl) at one time.

The discharge port arrays 22C, 22M, 22Y, 22K2*a*, 22K1, and 22K2*b* are connected to respective ink tanks (not illustrated) for storing and supplying corresponding ink. The recording head 9 and ink tanks according to the present exemplary embodiment may be integrally or separably configured.

Detailed compositions of the cyan ink (C), the magenta ink (M), the yellow ink (Y), the high-permeability black ink (K1), and the low-permeability black ink (K2) according to the present exemplary embodiment will be described below.

Figure 3:
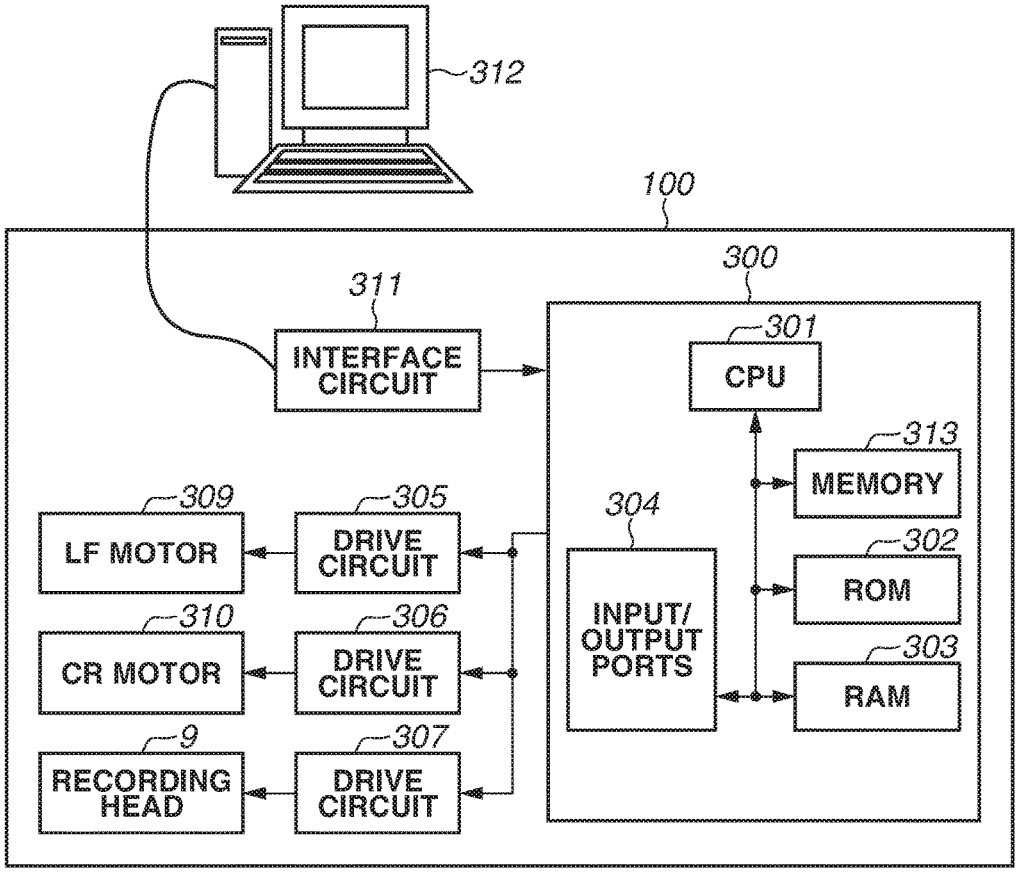
FIG. 3 is a schematic view illustrating a recording control system according to an exemplary embodiment.

FIG. 3 is a block diagram schematically illustrating a configuration of a control system in a recording apparatus 100 according to the present exemplary embodiment. A main control unit 300 includes a central processing unit (CPU) 301 for performing processing operations (calculation, selection, determination, control, etc.) and recording operations, a read only memory (ROM) 302 for storing a control program to be executed by the CPU 301, a random access memory (RAM) 303 used as a recording data buffer, and an input/output port 304. A memory 313 stores image data, mask pattern portions, quantization patterns, and edge data/non-edge data split patterns (described below). The input/output port 304 is connected with drive circuits 305, 306, and 307 of a conveyance motor (LF motor) 309, a carriage motor (CR motor) 310, and the recording head 9 (and an actuator in a cutting unit), respectively. The main control unit 300 is connected with a personal computer (PC) 312 as a host computer via an interface circuit 311.

(Data Processing Process)

Figure 4:
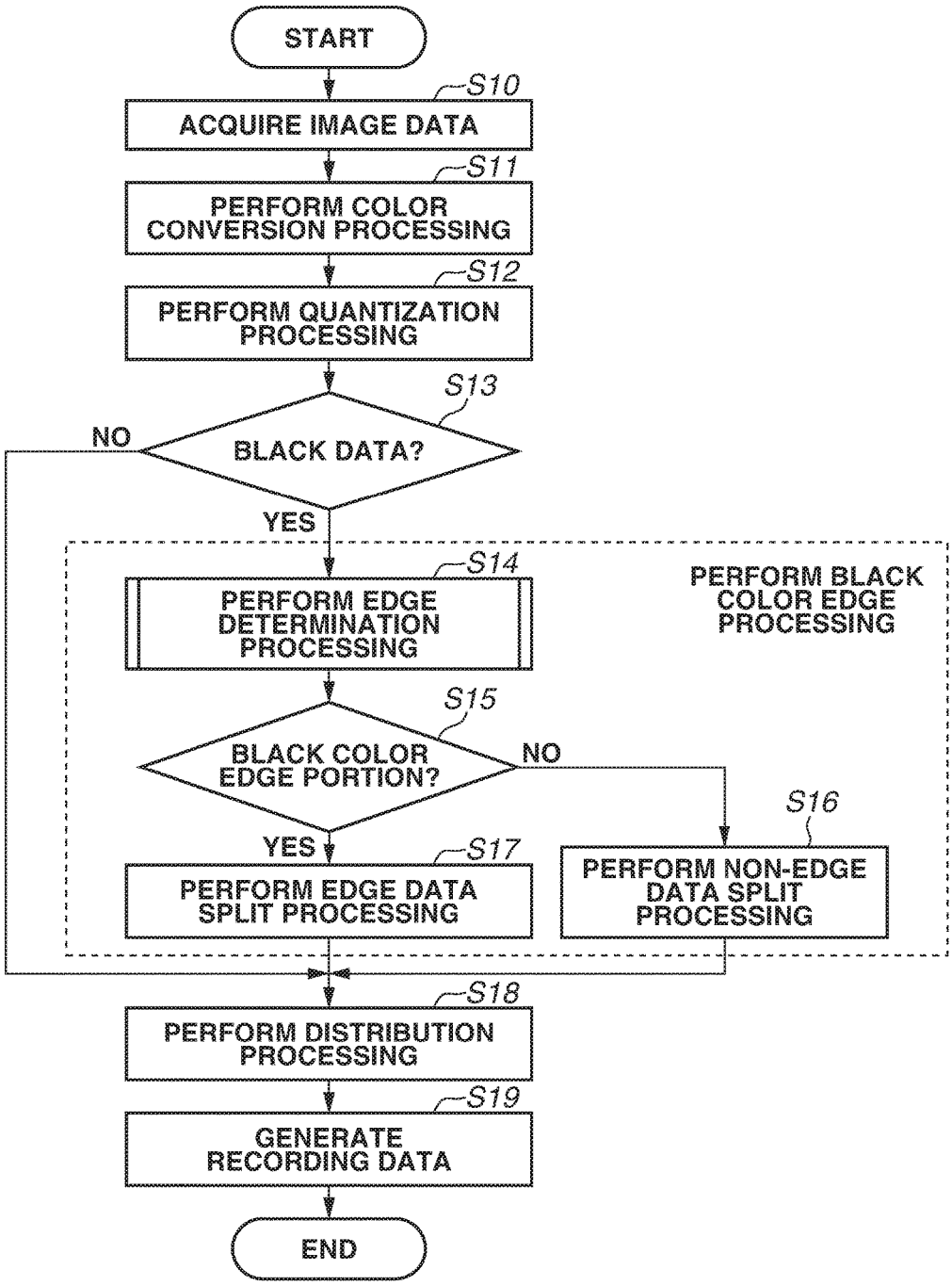
FIG. 4 illustrates a data processing process according to an exemplary embodiment.

FIG. 4 is a flowchart illustrating processing for generating recording data to be used for recording, performed by the CPU 301 on a basis of a control program according to the present exemplary embodiment.

In step S10, the recording apparatus 100 acquires red, green, and blue (RGB) format image data input from the PC 312 serving as a host computer.

In step S11, the CPU 301 performs color conversion processing for converting the RGB format image data into multi-value data corresponding to ink colors (cyan, magenta, yellow, and black (CMYK)) used for recording. This color conversion processing generates multi-value data represented by information of 8-bit 256 values for defining the gradation of C, M, Y, and K ink in each pixel group composed of a plurality of pixels.

In step S12, the CPU 301 performs quantization processing for quantizing the multi-value data. This quantization processing generates quantization data represented by 1-bit binary information which defines discharge or non-discharge of C, M, Y, and K ink for each pixel. As a quantization method, dither processing, error diffusion processing, and other methods can be applied.

In step S13, the CPU 301 extracts black ink data (black data) from among the quantization data. In a case where the black data is extracted (YES in step S13), the processing proceeds to step S14. In step S14, the CPU 301 starts black color edge processing. The black color edge processing performed in steps S14 to S17 will be described in detail below. After the black color edge processing is performed, the processing proceeds to step S18.

On the other hand, in case where the CPU 301 extracts cyan ink data, magenta ink data, or yellow ink data (color data) from among the quantization data (NO in step S13), the processing proceeds to step S18. In this case, the CPU 301 does not perform the black color edge processing.

In step S18, the CPU 301 performs distribution processing for distributing the quantization data to a plurality of scans of the recording head 9 in multipass recording. In step S19, the CPU 301 generates record data represented by 1-bit binary information for defining discharge or non-discharge of C, M, Y, K1, and K2 ink for each pixel in each of a plurality of scans on a unit area on the recording medium.

Although all of the processing in steps S10 to S19 is performed by the CPU 301 in the recording apparatus 100, the configuration is not limited thereto, and other forms of embodiment are also possible. For example, all of the processing in steps S10 to S19 may be performed by the PC 312. For example, the color conversion process in step S11 may be performed by the PC 312, and the quantization processing in step S12 and subsequent processing may be performed by the recording apparatus 100.

(Ink Composition)

Different types of ink used in the present exemplary embodiment will be described below. Hereinafter, unless otherwise noted, "mass parts" and "mass %" denote the mass-standard.

Preparing Cyan Ink (1) Preparing Dispersion Liquid

Using benzyl acrylate and methacrylic acid as raw materials, an AB type block polymer having an acid value of 250 and a number-average molecular weight of 3000 was made through a normally practiced method. Then, the block polymer was neutralized with a potassium hydrate solution and then diluted with ion-exchange water to prepare a homogeneous solution with a polymer concentration of 50 mass %.

Two hundred grams of the above-described polymer solution, 100 g of C.I. Pigment Blue 15:3, and 700 g of ion exchange water were mixed. After mechanically agitating the mixture for a predetermined time period, non-dispersed substances containing coarse particles were eliminated through centrifugal separation processing to obtain a cyan dispersion liquid. The pigment concentration of the obtained cyan dispersion liquid was 10 mass %.

(2) Preparing Ink

The above-described cyan dispersion liquid was used to prepare ink. After adding the following components to the above-described cyan dispersion liquid and sufficiently mixing and agitating the mixture, the liquid was applied with pressure filtration by using a micro filter with a pore size of 2.5 μm (from FUJIFILM Corporation) to prepare pigmented ink with a pigment concentration of 2 mass %.

| | |
|---|---|
| Above-described cyan dispersion liquid | 20 mass parts |
| Glycerin | 10 mass parts |
| Diethylene glycol | 10 mass parts |

-continued

| | |
|---|---|
| 2-pyrrolidone | 5 mass parts |
| Acetylene glycol EO addition compound (from Kawaken Fine Chemicals Co., Ltd.) | 1.0 mass parts |
| Ion-exchange water | Remaining mass parts |

Preparing Magenta Ink (1) Preparing Dispersion Liquid

First, using benzyl acrylate and methacrylic acid as raw materials, an AB type block polymer having an acid value of 300 and a number-average molecular weight of 2500 was made through a normally practiced method. Then, the block polymer was neutralized with a potassium hydrate solution and then diluted with ion-exchange water to prepare a homogeneous solution with a polymer concentration of 50 mass %.

One hundred grams of the above-described polymer solution, 100 g of C.I. Pigment Red 122, and 800 g of ion exchange water were mixed. After mechanically agitating the mixture for a predetermined time period, non-dispersed substances containing coarse particles were eliminated through centrifugal separation processing to obtain a magenta dispersion liquid. The pigment concentration of the obtained magenta dispersion liquid was 10 mass %.

(2) Preparing Ink

The above-described magenta dispersion liquid was used to prepare ink. After adding the following components to the above-described magenta dispersion liquid and sufficiently mixing and agitating the mixture, the liquid was applied with pressure filtration by using a micro filter with a pore size of 2.5 μm (from FUJIFILM Corporation) to prepare pigmented ink with a pigment concentration of 4 mass %.

| | |
|---|---|
| Above-described magenta dispersion liquid | 40 mass parts |
| Glycerin | 10 mass parts |
| Diethylene glycol | 10 mass parts |
| 2-pyrrolidone | 5 mass parts |
| Acetylene glycol EO addition compound (from Kawaken Fine Chemicals Co., Ltd.) | 1.0 mass parts |
| Ion-exchange water | Remaining mass parts |

Preparing Yellow Ink (1) Preparing Dispersion Liquid

First of all, the above-described anionic polymer P-1 was neutralized with a potassium hydrate solution and then diluted with ion exchange water to prepare a homogeneous solution with a polymer concentration of 10 mass %.

Three hundred grams of the above-described polymer solution, 100 g of C.I. Pigment Yellow 74, and 600 g of ion exchange water were mixed. After mechanically agitating the mixture for a predetermined time period, non-dispersed substances containing coarse particles were eliminated through centrifugal separation processing to obtain a yellow dispersion liquid. The pigment concentration of the obtained yellow dispersion liquid was 10 mass %.

(2) Preparing Ink

After adding the following components to the above-described yellow dispersion liquid and sufficiently agitating the mixture for solution and dispersion, the liquid was applied with pressure filtration by using a micro filter with a pore size of 1.0 μm (from FUJIFILM Corporation) to prepare pigmented ink with a pigment concentration of 4 mass %.

| | |
|---|---|
| Above-described yellow dispersion liquid | 40 mass parts |
| Glycerin | 9 mass parts |
| Ethylene glycol | 10 mass parts |
| 2-pyrrolidone | 5 mass parts |
| Acetylene glycol EO addition compound (from Kawaken Fine Chemicals Co., Ltd.) | 1.0 mass parts |
| Ion-exchange water | Remaining mass parts |

Preparing High-Permeability Black Ink (K1)

(1) Preparing Dispersion Liquid

First of all, an anionic polymer P-1 having an acid value of 202 and a weight-average molecular weight of 6500 was prepared. The polymerization ratios (weight ratios) of styrene, butyl acrylate, and acrylic acid copolymer are 30, 40, and 30, respectively. The anionic polymer P-1 was neutralized with a potassium hydrate solution and then diluted with ion exchange water to prepare a homogeneous polymer solution with a pigment concentration of 10 mass %.

Six hundred grams of the above-described polymer solution, 100 g of carbon black, and 300 g of ion exchange water were mixed. After mechanically agitating the mixture for a predetermined time period, non-dispersed substances containing coarse particles were eliminated through centrifugal separation processing to obtain a black dispersion liquid. The pigment concentration of the obtained black dispersion liquid was 10 mass %.

(2) Preparing Ink

The above-described black dispersion liquid was used to prepare ink. After adding the following components to the above-described black dispersion liquid and sufficiently mixing and agitating the mixture, the liquid was applied with pressure filtration by using a micro filter with a pore size of 2.5 μm (from FUJIFILM Corporation) to prepare pigmented ink with a pigment concentration of 5 mass %.

| | |
|---|---|
| Above-described black dispersion liquid | 50 mass parts |
| Glycerin | 10 mass parts |
| Triethylene glycol | 10 mass parts |
| Acetylene glycol EO addition compound (from Kawaken Fine Chemicals Co., Ltd.) | 1.0 mass parts |
| Ion-exchange water | Remaining mass parts |

Preparing Low-Permeability Black Ink (K2)

The above-described black dispersion liquid produced in high-permeability black ink was used. After adding the following components to the above-described black dispersion liquid and sufficiently mixing and agitating the mixture, the liquid was applied with pressure filtration by using a micro filter with a pore size of 2.5 μm (from FUJIFILM Corporation) to prepare pigmented ink with a pigment concentration of 3 mass %.

| | |
|---|---|
| Above-described black dispersion liquid | 30 mass parts |
| Glycerin | 10 mass parts |
| Triethylene glycol | 10 mass parts |
| 2-pyrrolidone | 5 mass parts |
| Acetylene glycol EO addition compound (from Kawaken Fine Chemicals Co., Ltd.) | 0.1 mass parts |
| Ion-exchange water | Remaining mass parts |

According to the present exemplary embodiment, as described above, the high-permeability black ink (K1) was adjusted to provide high permeability over a recording medium and the low-permeability black ink (K2) was adjusted to provide low permeability over a recording medium.

The degree of permeability of ink over a recording medium can be evaluated by using the magnitude of the surface tension of the ink as an index. More specifically, the permeability over a recording medium decreases with increasing surface tension of ink.

The surface tension of each ink used in the present exemplary embodiment will be described in Table 1.

TABLE 1

| | Surface tension [mN/m] |
|---|---|
| Cyan ink (C) | 28.5 |
| Magenta ink (M) | 28.3 |
| Yellow ink (Y) | 28.6 |
| High-permeability black ink (K1) | 28.8 |
| Low-permeability black ink (K2) | 39.4 |

As described in Table 1, the cyan ink (C), the magenta ink (M), the yellow ink (Y), and the high-permeability black ink (K1) used in the present exemplary embodiment have almost the same surface tension. More specifically, the cyan ink (C), the magenta ink (M), the yellow ink (Y), and the high-permeability black ink (K1) have almost the same permeability over a recording medium.

On the other hand, the low-permeability black ink (K2) has a remarkably higher surface tension than the high-permeability black ink (K1). More specifically, the low-permeability black ink (K2) has lower permeability over a recording medium than the high-permeability black ink (K1).

In one embodiment, the surface tensions of the cyan ink (C), the magenta ink (M), the yellow ink (Y), and the high-permeability black ink (K1) fall within a range from 20 to 35 [mN/m], or a range from 20 to 30 [mN/m]. On the other hand, the surface tension of the low-permeability black ink (K2) may fall within a range from 35 to 50 [mN/m], or a range from 35 to 40 [mN/m].

In the present specification, "surface tension" refers to both static surface tension and dynamic surface tension. The static surface tension of ink is measured by using the Automatic Surface Tensiometer CBVP-Z (from Kyowa Interface Science Co., Ltd.) after adjusting the ink temperature to 25° C. On the other hand, the dynamic surface tension can be measured by adopting the maximum bubble pressure method for forming air bubbles in a liquid and measuring internal pressure variations. As a measurement apparatus, for example, the Bubble Pressure Tesiometer BP2 from KRUSS GmbH can be used. Generally with the progress of the interface formation time (the time elapsed from the moment when an ink droplet lands on a recording medium), the dynamic surface tension gradually decreases to be stably converges to the value of the static surface tension. According to the inventor's studies, particularly with plain paper as a recording medium, there has been acquired knowledge that the value of the dynamic surface tension with an interface formation time of about 10 milliseconds profoundly affects image defect.

(Image Quality Degradation on Black Color Edge)

Since black is used for text portions in a recorded image, higher color density of the black ink is more desirable. Therefore, according to the present exemplary embodiment, only the low-permeability black ink (K2) providing low permeability and high color density on other than the black color edge (described below) is discharged for recording on an area on a recording medium where only black ink is discharged for recording (hereinafter also referred to as a black area).

However, if only the low-permeability black ink (K2) is discharged on the boundary (also referred to as a black color edge) between an area on the recording medium where at least any one of cyan ink, magenta ink, and yellow ink is discharged for recording (also referred to as a color area) and a black area adjoining the color area, the image quality may possibly degrade depending on record conditions.

Figure 5A:
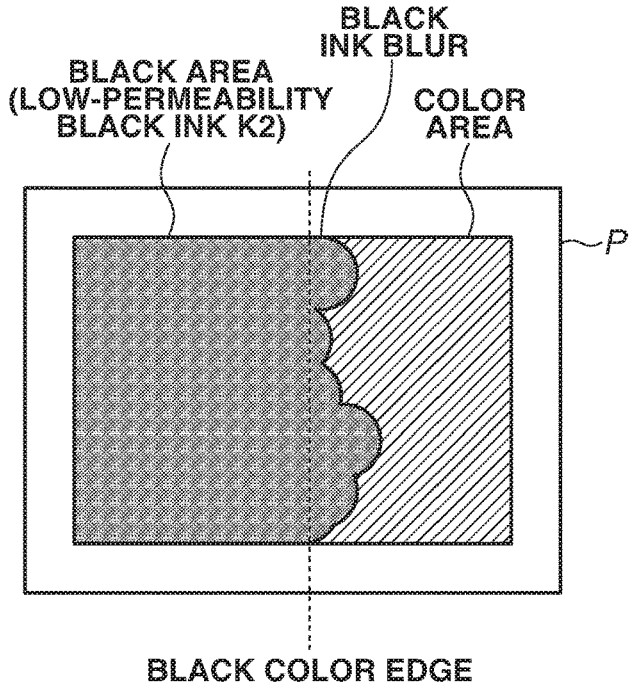
FIGS. 5A and 5B illustrate image quality degradation in a black color edge.

FIG. 5A illustrates an image recorded when only the low-permeability black ink (K2) from among the above-described high-permeability black ink (K1) and low-permeability black ink (K2) is discharged to the black color edge. FIG. 5A illustrates a case where the low-permeability black ink (K2) is discharged to the black area with a 100% recording duty, and the yellow ink (Y) is discharged to the color area with a 100% recording duty. Standard plain paper (from Canon Inc.) is used as the recording medium P.

If ink having a high surface tension and ink having a low surface tension contact each other on the recording medium P, the ink having a high surface tension bleeds into the ink having a low surface tension. This is what is called a bleeding phenomenon. As described in Table 1, the low-permeability black ink (K2) has a higher surface tension than the color ink. Therefore, as illustrated in FIG. 5A, the low-permeability black ink (K2) applied to the black area on the recording medium P is blurred on the color area, possibly deforming the contour of the black color edge.

On the other hand, even if only the high-permeability black ink (K1) is discharged to the black color edge, image quality degradation may possibly occur.

Figure 5B:
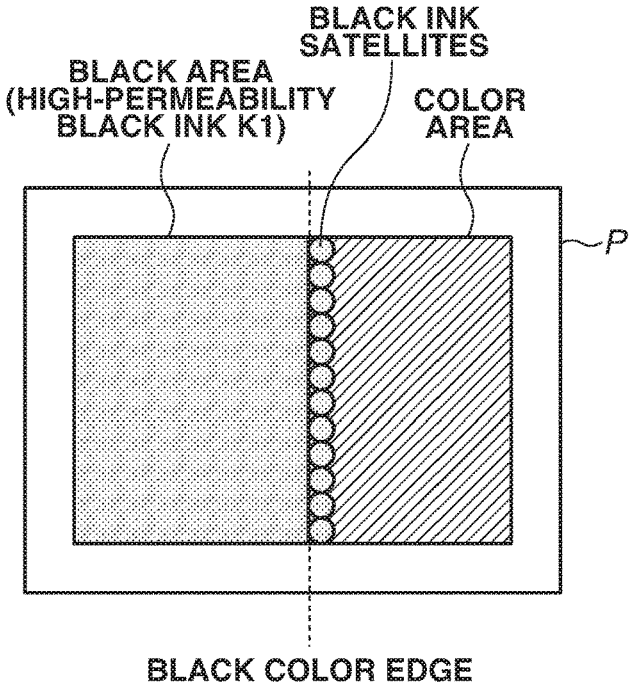

FIG. 5B illustrates an image recorded when only the high-permeability black ink (K1) from among the above-described high-permeability black ink (K1) and low-permeability black ink (K2) is discharged to the black color edge. FIG. 5B illustrates a case where the high-permeability black ink (K1) is discharged to the black area with a 100% recording duty, and the yellow ink (Y) is discharged to the color area with a 100% recording duty. Standard plain paper (from Canon Inc.) is used as the recording medium P.

When ink having a low surface tension is discharged, it is likely to split into a large ink droplet (also referred to as a main droplet) and small ink droplets (also referred to as satellites). Therefore, applying only the high-permeability black ink (K1) to the black color edge causes a comparatively large discharge amount of the high-permeability black ink (K1), resulting in a large number of satellites.

A satellite is more likely to be affected by an air current than the main droplet, and hence is likely to produce a landing position deviation. Therefore, as illustrated in FIG. 5B, a large number of satellites of the high-permeability black ink are applied to the color area because of the influence of a landing position deviation. As a result, the boundary between the color area and the black area becomes ambiguous.

In consideration of the above-described situation, the present exemplary embodiment discharges both the high-permeability black ink (K1) and the low-permeability black ink (K2) to the black color edge to perform recording.

Figure 6:
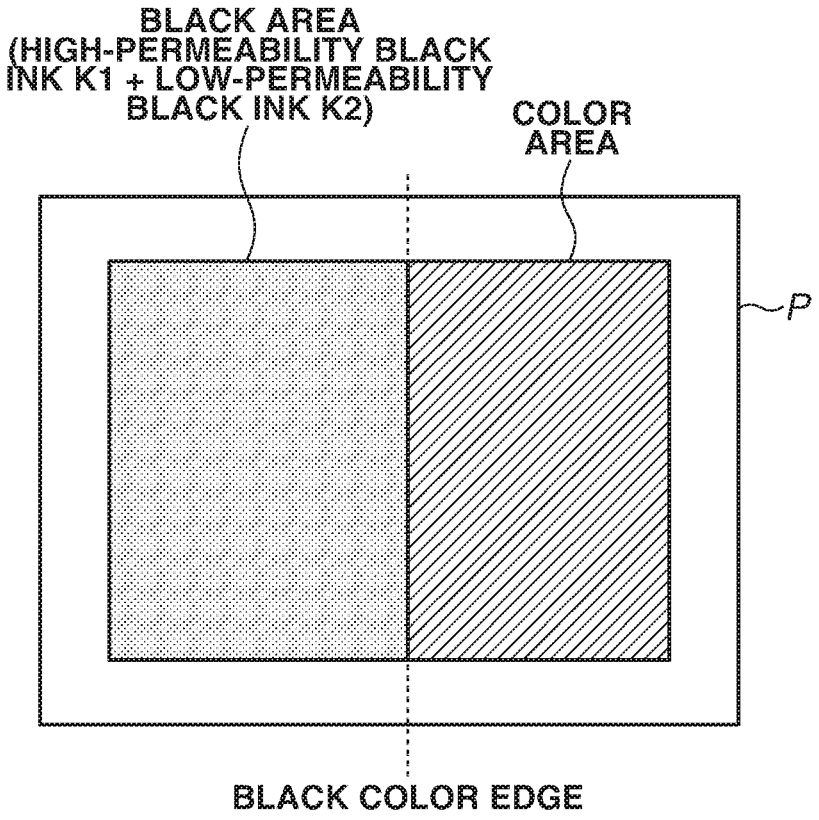
FIG. 6 illustrates prevention of image quality degradation in a black color edge.

FIG. 6 illustrates an image recorded when both the high-permeability black ink (K1) and the low-permeability black ink (K2) are discharged to the black color edge. FIG. 6 illustrates a case where the high-permeability black ink (K1) is discharged to the black area with a 50% recording duty, the low-permeability black ink (K2) is discharged to the black area with a 50% recording duty, and the yellow ink (Y) is discharged to the color area with a 100% recording duty. Standard plain paper (from Canon Inc.) is used as the recording medium P.

Discharging both the high-permeability black ink (K1) and the low-permeability black ink (K2) to the black color edge enables comparatively reducing the discharge amount of the high-permeability black ink (K1), preventing the occurrence of satellites. Further, since the high-permeability black ink (K1) and the low-permeability black ink (K2) contact each other and are mixed on the recording medium P, the surface tension of the black ink can be reduced compared to a case where only the low-permeability black ink (K2) is discharged. This reduces the difference in surface tension from the color ink, and thus the occurrence of the phenomenon of the black ink bleeding into the color area can be prevented.

As a result, it becomes possible to prevent image quality degradation in the black color edge, as illustrated in FIG. 6. When the scanning speed of the recording head 9 is high (for example, 40 inches per second or higher), the influence of satellites is likely to become remarkable. However, preventing the occurrence of satellites by using the above-described method enables improving the recording speed without degrading image quality.

(Black Color Edge Processing)

The black color edge processing according to the present exemplary embodiment will be described in detail below.

When the CPU 301 determines that the extracted data is black data (YES in step S13 in FIG. 4), the processing proceeds to step S14. In step S14, the CPU 301 performs processing for determining the black color edge.

Figure 7:
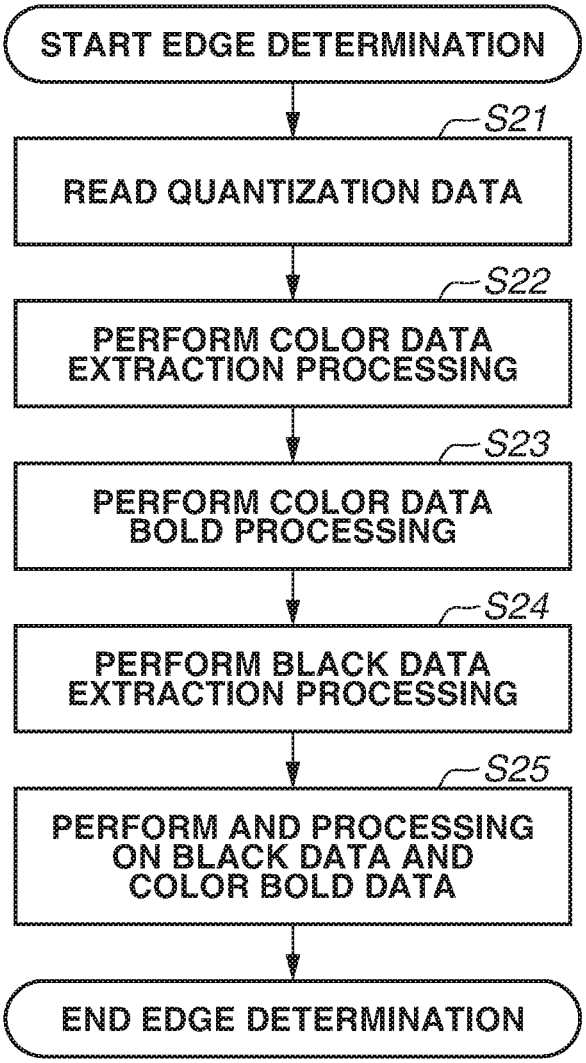
FIG. 7 illustrates an edge determination process according to an exemplary embodiment.
Figure 8A:
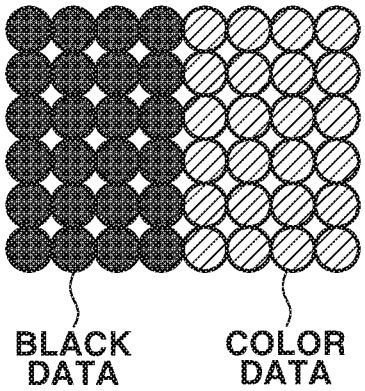
FIGS. 8A, 8B, and 8C illustrate edge determination according to an exemplary embodiment.
Figure 8B:
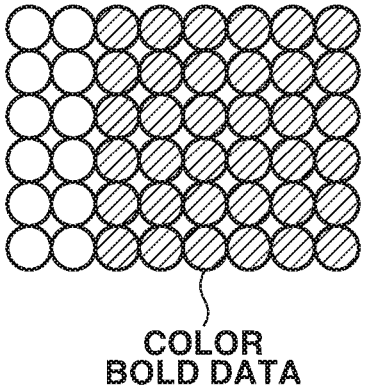
Figure 8C:
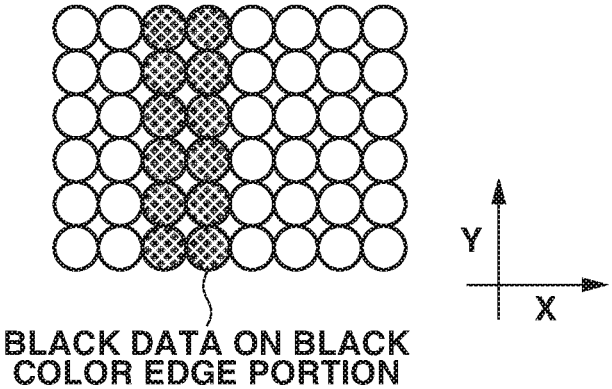

FIG. 7 is a flowchart illustrating the black color edge determination processing performed by the CPU 301 based on a control program according to the present exemplary embodiment. FIGS. 8A, 8B, and 8C illustrate a process of the black color edge determination processing illustrated in FIG. 7 performed on a certain image.

In step S21, the CPU 301 reads quantization data. The CPU 301 reads not only quantization data of the black ink (black data) but also quantization data of the color ink (color data). Actually, the CPU 301 reads, as quantization data of the color ink, the logical sum (OR) of information about ink discharge determined by quantization data of the cyan ink, quantization data of the magenta ink, and quantization data of the yellow ink. FIG. 8A schematically illustrates the black data and the color data read from a certain image in step S21. FIG. 8A illustrates an image including a black area and a color area adjoining each other.

In step S22, the CPU 301 extracts the color data. For example, with the data illustrated in FIG. 8A, the color data of four columns on the right-hand side in the X direction is extracted.

In step S23, the CPU 301 performs bold processing on the color data to generate color bold data. The bold processing refers to processing for enlarging specific data by shifting the address of the specific data by a predetermined amount in a certain direction and then performing the logical sum (OR) processing on the specific data before and after the shift. According to the present exemplary embodiment, as an example of the bold processing, the CPU 301 performs processing for shifting the color data by 2 pixels in the X direction to generate color bold data. FIG. 8B schematically illustrates the color bold data generated by performing the bold processing on the color data illustrated in FIG. 8A. As illustrated in FIG. 8B, the color bold data is generated by enlarging the color data illustrated in FIG. 8A by 2 pixels in the X direction.

In step S24, the CPU 301 extracts the black data. For example, with the data illustrated in FIG. 8A, the color data of four columns on the left-hand side in the X direction is extracted.

In step S25, the CPU 301 performs the logical product (AND) processing on the black data extracted in step S24 and the color bold data generated in step S23. Then, the CPU 301 stores the data obtained with this logical product (AND) processing in the memory 313 as the black data on a black color edge portion. Black data other than the black data on the black color edge portion is assumed to be black data on a non-black color edge portion. FIG. 8C schematically illustrates the black data on the black color edge portion obtained in step S25. Performing the logical product (AND) on the black data illustrated in FIG. 8A and the color bold data illustrated in FIG. 8B enables obtaining portions indicating ink discharge with both data, as the black data on the black color edge portion, as illustrated in FIG. 8C. As described in the comparison between FIGS. 8A and 8C, the black data on the black color edge portion illustrated in FIG. 8C corresponds to the vicinity of the boundary between the color area and the black data illustrated in FIG. 8A.

According to the present exemplary embodiment, the CPU 301 performs the black color edge determination in this way.

In step S23, the CPU 301 performs processing for enlarging the color data by 2 pixels in the X direction to determine the black color edge portion in the X direction. However, when determining the black color edge portion in the Y direction, the color data in the Y direction is to be enlarged. Although the color data is enlarged by 2 pixels in this case, the amount of data to be enlarged can be suitably changed. For example, in a case of a large influence of blur on the black color edge portion, the amount of data to be enlarged can be further increased to determine a wider range as the black color edge portion.

Even the black color edge portion is determined with a method other than the method described with reference to FIGS. 7, 8A, 8B, and 8C, the present exemplary embodiment described below is also applicable.

Returning to FIG. 4, after performing the black color edge determination processing in step S14, then in step S15, the CPU 301 classifies the black data into the black data on the black color edge portion and the black data on the non-black color edge portion. For the black data on the non-black color edge portion (NO in step S15), the processing proceeds to step S16. In step S16, the CPU 301 performs the discharge port array split processing on the non-black color edge (described below). On the other hand, for the black data on the black color edge portion (YES in step S15), the processing proceeds to step S17. In step S17, the CPU 301 performs the discharge port array split processing on the black color edge (described below).

In the discharge port array split processing for the non-black color edge in step S16, and the discharge port array split processing for the black color edge in step S17, the CPU 301 splits the black data into the discharge port array 22K2*a* for the low-permeability black ink (K2), the discharge port array 22K1 for the high-permeability black ink (K1), and the discharge port array 22K2*b* for the low-permeability black ink (K2) by using the split pattern corresponding to each discharge port array.

Figure 9A:
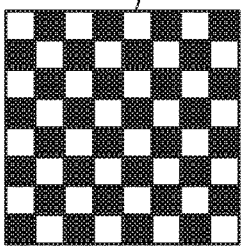
FIGS. 9A, 9B, 9C, 9D, 9E, and 9F are schematic views illustrating split patterns according to an exemplary embodiment.
Figure 9B:
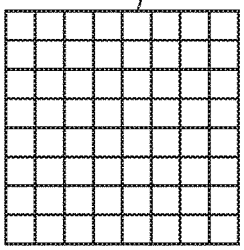
Figure 9C:
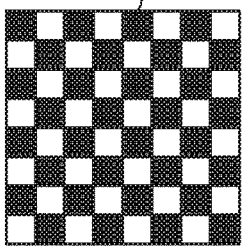
Figure 9D:
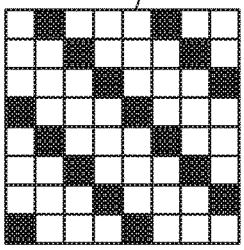
Figure 9E:
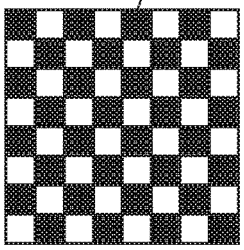
Figure 9F:
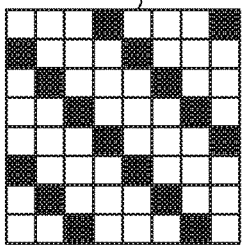

FIGS. 9A, 9B, and 9C illustrate a split pattern M_K2*a* corresponding to the discharge port array 22K2*a*, a split pattern M_K1 corresponding to the discharge port array 22K1, and a split pattern M_K2*b* corresponding to the discharge port array 22K2*b*, respectively, used in the discharge port array split processing for the non-black color edge. FIGS. 9D, 9E, and 9F illustrate a split pattern N_K2*a* corresponding to the discharge port array 22K2*a*, a split pattern N_K1 corresponding to the discharge port array 22K1, and a split pattern N_K2*b* corresponding to the discharge port array 22K2*b*, respectively, used in the discharge port array split processing for the black color edge. In each split pattern, the solidly shaded portions indicate pixels where ink discharge is permitted when ink discharge is defined in the input data (also referred to as recording permitted pixels). On the other hand, the non-shaded portions indicate pixels where ink discharge is not permitted even when ink discharge is defined in the input data (also referred to as recording non-permitted pixels).

As described above, the discharge ports discharge only the low-permeability black ink (K2) to a regular area in the black area, i.e., to the non-black color edge portion. Therefore, for the non-black color edge portion, the black data is distributed only to the discharge port arrays 22K2*a* and 22K2*b* among the discharge port arrays 22K2*a*, 22K1, and 22K2*b* illustrated in FIG. 2.

Therefore, as illustrated in FIGS. 9A and 9C, the present exemplary embodiment applies the split patterns M_K2*a* and M_K2*b* to the discharge port arrays 22K2*a* and 22K2*b*, respectively, for the non-black color edge portion. In this case, each of the split patterns M_K2*a* and M_K2*b* has a recording permission ratio of 50%, which is defined by the ratio of the number of recording permitted pixels to the total number of pixels. The split patterns M_K2*a* and M_K2*b* are designed so that the recording permitted pixels are arranged on an exclusive and a complementary way. On the other hand, the present exemplary embodiment applies the split pattern M_K1 to the discharge port array 22K1. In this case, the recording permission ratio illustrated in FIG. 9B is 0%. The split patterns M_K2*a*, M_K1, and M_K2*b* are applied in this way. This means that the high-permeability black ink (K1) is not discharged from the discharge port array 22K1 to the non-black color edge portion, and that the low-permeability black ink (K2) can be discharged from the discharge port arrays 22K2*a* and 22K2*b* to the non-black color edge portion with a recording permission ratio of about 50% for each.

On the other hand, both the high-permeability black ink (K1) and the low-permeability black ink (K2) are discharged to the black color edge portion in the black area. Therefore, the black data is distributed to all of the discharge port arrays 22K2*a* 22K1, and 22K2*b* illustrated in FIG. 2 to the black color edge portion. The present exemplary embodiment performs control so that the almost the same discharge amounts of the high-permeability black ink (K1) and the low-permeability black ink (K2) are discharged to the black color edge portion.

Therefore, the split pattern N_K1 illustrated in FIG. 9E is applied to the discharge port array 22K1 to the black color edge portion, with a recording permission ratio of 50%. On the other hand, the split patterns N_K2*a* and N_K2*b* illustrated in FIGS. 9D and 9F, respectively, are applied to the discharge port arrays 22K2*a* and 22K2*b*, respectively, to the black color edge, with a recording permission ratio of 25% for each. The split patterns N_K1, N_K2*a*, and N_K2*b* are designed so that the recording permitted pixels are arranged on an exclusive and a complementary way. The split patterns N_K2*a*, N_K1, and N_K2*b* are applied in this way. This means that the high-permeability black ink (K1) can be discharged from the discharge port array 22K1 to the black color edge portion with a recording permission ratio of about 50%, and that the low-permeability black ink (K2) can be discharged from the discharge port arrays 22K2*a* and 22K2*b* to the black color edge portion, with a recording permission ratio of about 25% for each, i.e., 50% in total.

According to the present exemplary embodiment, as described above, both the high-permeability black ink (K1) and the low-permeability black ink (K2) can be discharged to the black color edge portion having a possibility of image quality degradation. Therefore, it becomes possible to prevent the occurrence of the bleeding phenomenon of the low-permeability black ink (K2) and the occurrence of satellites of the high-permeability black ink (K1) on the black color edge portion.

Although, in the present exemplary embodiment, the recording permission ratios of the high-permeability black ink (K1) and the low-permeability black ink (K2) to the black color edge portion are equalized to 50%, the recording permission ratios of the two types of ink can be suitably changed to different values. For example, in a case where the bleeding phenomenon is likely to occur, the recording permission ratio of the low-permeability black ink (K2) may be reduced to 30% and the recording permission ratio of the high-permeability black ink (K1) may be 70%. For example, in a case where satellites are likely to occur, the recording permission ratio of the high-permeability black ink (K1) may be reduced to 30% and the recording permission ratio of the low-permeability black ink (K2) may be 70%. The sum total of the recording permission ratios of the high-permeability black ink (K1) and the low-permeability black ink (K2) are not necessarily 100%. For example, as long as the degradation of the optical density is not conspicuous, the recording permission ratio of the high-permeability black ink (K1) may be 40% and the recording permission ratio of the low-permeability black ink may be 40%, i.e., 80% in total.

The present exemplary embodiment has been described above centering on a configuration in which the split patterns N_K1, N_K2*a*, and N_K2*b* are designed so that the recording permitted pixels are arranged on an exclusive and a complementary way, and the high-permeability black ink (K1) and the low-permeability black ink (K2) are applied to different pixels on the black color edge portion. However, other forms of embodiment are also applicable. For example, if the high-permeability black ink (K1) and the low-permeability black ink (K2) are applied to the same pixel on the black color edge portion, the two types of ink can suitably contact each other on a recording medium. Therefore, the surface tension of the low-permeability black ink (K2) is easily reduced, making it possible to suitably prevent the occurrence of the bleeding phenomenon on the black color edge portion. However, in this case, since two types of ink are applied to the same pixel in a superimposed way, it is to be considered that graininess does not increase too much.

The first exemplary embodiment has been described above centering on a configuration in which both the high-permeability black ink (K1) and the low-permeability black ink (K2) are discharged to the black color edge portion to perform recording.

According to a second exemplary embodiment, on the other hand, recording is made by controlling the discharge order of the high-permeability black ink (K1) and the low-permeability black ink (K2) in addition to performing control according to the first exemplary embodiment. More specifically, the present exemplary embodiment controls ink discharge so that the high-permeability black ink (K1) and the low-permeability black ink (K2) are discharged in this order.

Descriptions of elements similar to those in the first exemplary embodiment will be omitted.

To prevent the occurrence of the bleeding phenomenon, the high-permeability black ink (K1) and the low-permeability black ink (K2) to the black color edge portion are to be discharged in this order.

When the high-permeability black ink (K1) is applied first to a recording medium as in the present exemplary embodiment, the low-permeability black ink (K2) and the high-permeability black ink (K1) immediately contact each other when the low-permeability black ink (K2) is subsequently applied to the recording medium. Therefore, the surface tension of the low-permeability black ink (K2) immediately decreases, making it possible to suitably prevent the low-permeability black ink (K2) from bleeding into the color area.

If the low-permeability black ink (K2) and the high-permeability black ink (K1) are discharged in this order, only the low-permeability black ink (K2) exists in the black area until the high-permeability black ink (K1) is applied. Therefore, on the black color edge portion, the low-permeability black ink (K2) having a high surface tension and the color ink having a low surface tension adjoin each other until the high-permeability black ink (K1) is applied. Therefore, the low-permeability black ink (K2) may possibly bleed into the color area to produce blur before the high-permeability black ink (K1) is applied.

Using the above-described different types of ink, the degree of the black ink bleeding into the color area was measured through an experiment for the following three different cases: (1) The high-permeability black ink (K1) and the low-permeability black ink (K2) are discharged without controlling the discharge order, (2) The high-permeability black ink (K1) and the low-permeability black ink (K2) are discharged in this order, and (3) The low-permeability black ink (K2) and the high-permeability black ink (K1) are discharged in this order. Experimental results are described in Table 2. In recording, the high-permeability black ink (K1) and the low-permeability black ink (K2) were discharged with a recording permission ratio of 50% for each. The distance of the black ink bleeding into the color image was observed by using the Digital Microscope KH-3000 (from HIROX Co., Ltd.) and then measured by using the Objective Micrometer (from Nikon Corporation). The experimental method is not limited thereto as long as the black ink bleeding into the color image can be confirmed and the distance thereof can be measured.

TABLE 2

| | Bleeding distance [μm] | Bleeding prevention effect |
|---|---|---|
| (1) Discharge order not controlled | 10.7 | Very good |
| (2) High-permeability and low-permeability black ink discharged in this order | 10.1 | Excellent |
| (3) Low-permeability and high-permeability black ink discharged in this order | 11.1 | Good |

As described in Table 2, it was confirmed that the case (2), "The high-permeability black ink (K1) and the low-permeability black ink (K2) are discharged in this order", between the three different cases, provides a shortest bleeding distance of 10.1 μm and a highest bleeding prevention effect. It was also confirmed that the case (1), "The high-permeability black ink (K1) and the low-permeability black ink (K2) are discharged without controlling the discharge order", provides a higher bleeding prevention effect than the case (3), "The low-permeability black ink (K2) and the high-permeability black ink (K1) are discharged in this order".

In consideration of the above-described points, the present exemplary embodiment discharges the high-permeability black ink (K1) and the low-permeability black ink (K2) to the black color edge portion in this order, suitably preventing the occurrence of the bleeding phenomenon.

Figure 10A:
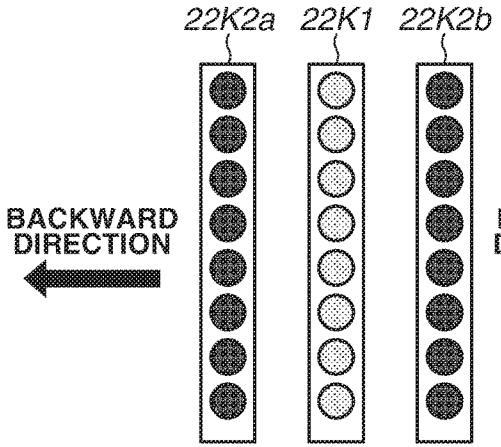
FIGS. 10A, 10B, and 10C illustrate the order of black ink discharge according to an exemplary embodiment.
Figure 10B:
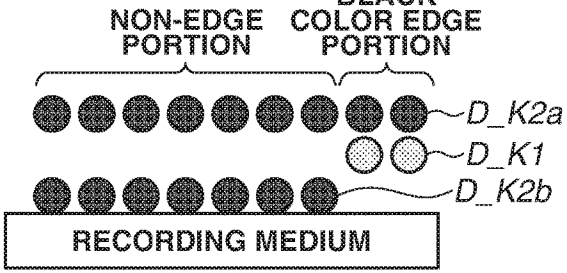
Figure 10C:
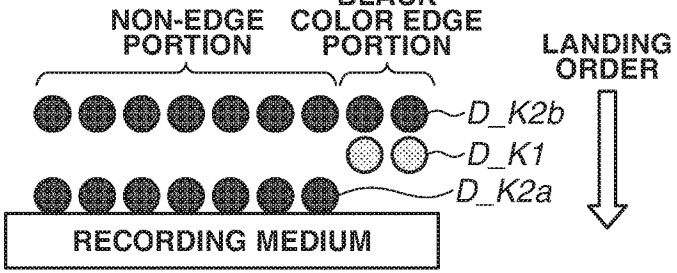

FIGS. 10A, 10B, and 10C illustrate the order of black ink discharge according to the present exemplary embodiment.

FIG. 10A illustrates the vicinity of the discharge port array 22K2*a* for the low-permeability black ink (K2), the discharge port array 22K1 for the high-permeability black ink (K1), and the discharge port array 22K2*b* for the low-permeability black ink (K2) of the recording head 9 illustrated in FIG. 2.

According to the present exemplary embodiment, an ink discharge operation is performed while the recording head 9 reciprocally moves in the X direction for scanning, the order of ink discharge from each discharge port array differs between the forward scanning (from left to right) and the backward scanning (from right to left). In the forward scanning, an ink droplet D_K2*b*, an ink droplet D_K1 is discharged from the discharge port array 22K2*b*, and an ink droplet D_K2*a* is discharged from the discharge port array 22K2*a* in this order. In the backward scanning, an ink droplet D_K2*a* is discharged from the discharge port array 22K2*a*, an ink droplet D_K1 is discharged from the discharge port array 22K1, and an ink droplet D_K2*b* is discharged from the discharge port array 22K2*b* in this order.

Therefore, according to the present exemplary embodiment, the discharge port arrays to be used for ink discharge are differentiated for each scanning direction.

More specifically, in the forward scanning, ink is discharged from the discharge port arrays 22K1 and 22K2*a* to the black color edge portion. As illustrated in FIG. 10B, after applying the ink droplet D_K1 of the high-permeability black ink (K1) from the discharge port array 22K1 to the black color edge portion, the ink droplet D_K2*a* of the low-permeability black ink (K2) can be applied from the discharge port array 22K2*a* to the black color edge portion.

On the other hand, in the backward scanning, ink is discharged from the discharge port arrays 22K1 and 22K2*b* to the black color edge portion. As illustrated in FIG. 10C, after applying the ink droplet D_K1 of the high-permeability black ink (K1) from the discharge port array 22K1 to the black color edge portion, the ink droplet D_K2*b* of the low-permeability black ink (K2) can be applied from the discharge port array 22K2*b* to the black color edge portion.

According to the present exemplary embodiment, as described above, the discharge port arrays to be used for ink discharge are differentiated for each scanning direction. In both the forward scanning and the backward scanning, the high-permeability black ink (K1) and the low-permeability black ink (K2) are discharged to the black color edge portion in this order.

Figure 11:
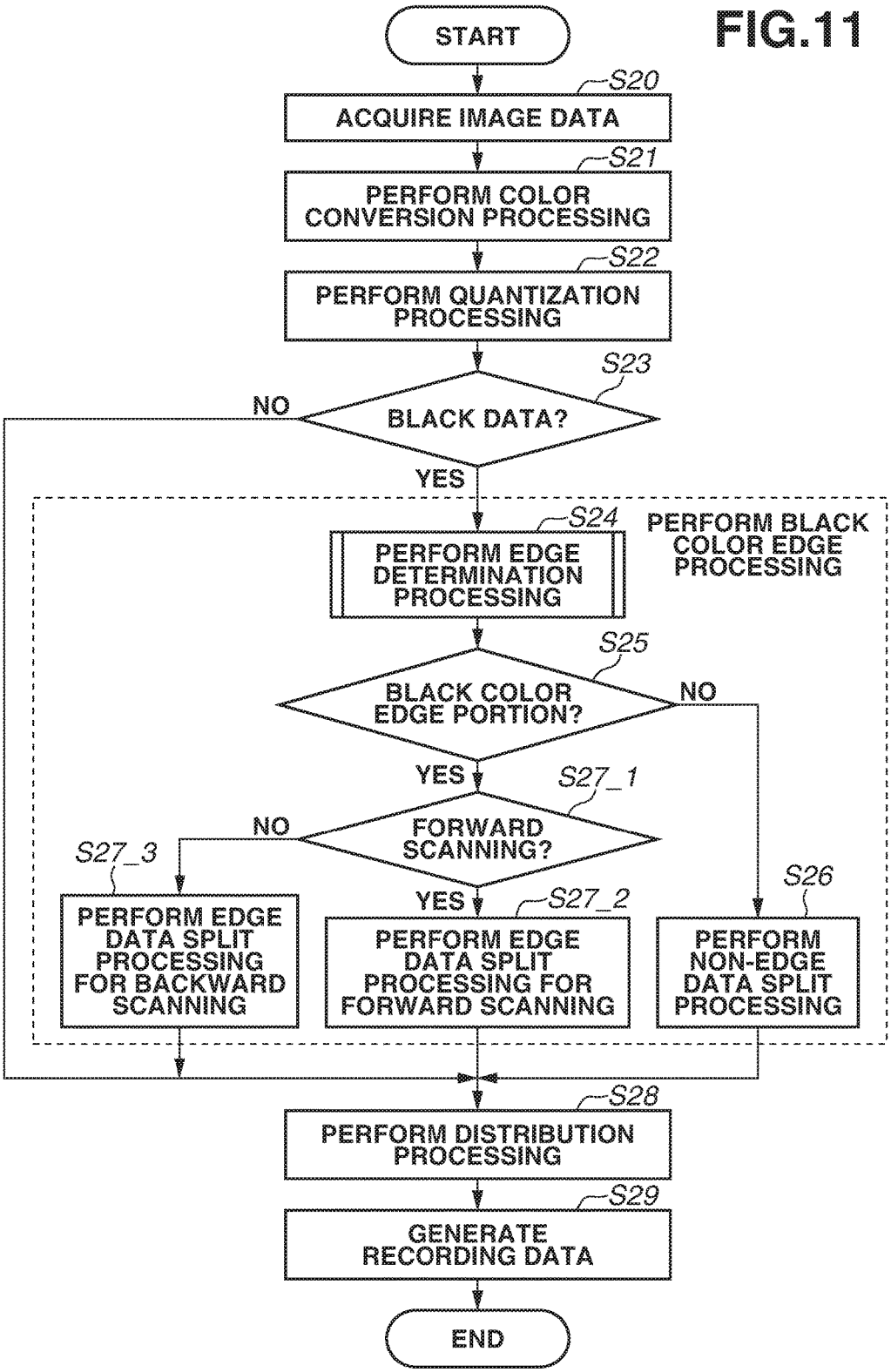
FIG. 11 illustrates a data processing process according to an exemplary embodiment.

FIG. 11 is a flowchart illustrating recording data generation processing performed by the CPU 301 on the basis of a control program according to the present exemplary embodiment. The processing in steps S20 to S26, S28, and S29 illustrated in FIG. 11 are similar to the processing in steps S10 to S16, S18, and S19 illustrated in FIG. 4, respectively, descriptions thereof will be omitted.

In step S27_1, the CPU 301 determines whether the black data on the black color edge portion obtained in step S25 is data to be used for the forward scanning of the recording head 9 or data to be used for backward scanning. When the CPU 301 determines that the obtained data is data to be used for the forward scanning (YES in step S27_1), the processing proceeds to step S27_2. In step S27_2, the CPU 301 performs the edge data split processing for the forward scanning. On the other hand, when the CPU 301 determines that the obtained data is data to be used for the backward scanning (NO in step S27_1), the processing proceeds to step S27_3. In step S27_3, the CPU 301 performs the edge data split processing for the backward scanning.

Figure 12A:
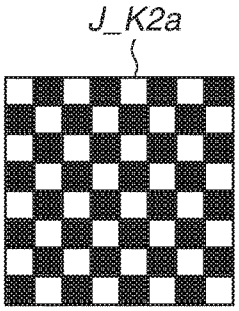
FIGS. 12A, 12B, 12C, 12D, 12E, and 12F are schematic views illustrating split patterns according to an exemplary embodiment.
Figure 12B:
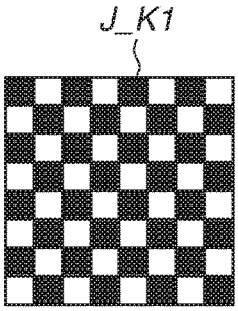
Figure 12C:
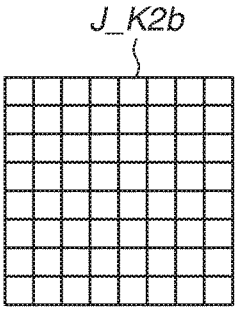
Figure 12D:
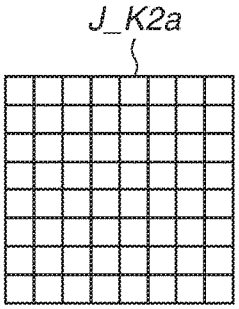
Figure 12E:
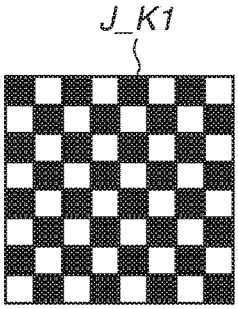
Figure 12F:
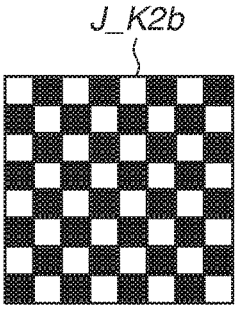

FIGS. 12A, 12B, and 12C illustrate a split pattern J_K2*a* corresponding to the discharge port array 22K2*a*, a split pattern J_K1 corresponding to the discharge port array 22K1, and a split pattern J_K2*b* corresponding to the discharge port array 22K2*b*, respectively, used in the discharge port array split processing for the black color edge for the forward scanning. FIGS. 12D, 12E, and 12F illustrate a split pattern L_K2*a* corresponding to the discharge port array 22K2*a*, a split pattern L_K1 corresponding to the discharge port array 22K1, and a split pattern L_K2*b* corresponding to the discharge port array 22K2*b*, respectively, used in the discharge port array split processing for the black color edge for the backward scanning. In each split pattern, the solidly shaded portions indicate pixels where ink discharge is permitted when ink discharge is defined in the input data (these pixels are also referred to as recording permitted pixels). On the other hand, the non-shaded portions indicate pixels where ink discharge is not permitted even when ink discharge is defined in the input data (these pixels are also referred to as recording non-permitted pixels).

In the forward scanning according to the present exemplary embodiment, as described above, the black ink is discharged only from the discharge port arrays 22K1 and 22K2*a* to the black color edge portion. Therefore, in the forward scanning, the black data corresponding to the black color edge portion is distributed only to the discharge port arrays 22K2*a* and 22K1 among the discharge port arrays 22K2*a*, 22K1, and 22K2*b* illustrated in FIG. 2.

Therefore, in the forward scanning according to the present exemplary embodiment, the split patterns J_K2*a* and J_K1 (illustrated in FIGS. 12A and 12B, respectively) with a recording permission ratio of 50% for each are applied to the discharge port array 22K2*a* and 22K1, respectively, for the black data corresponding to the black color edge portion. The split patterns J_K2*a* and J_K1 are designed so that the recording permitted pixels are arranged on an exclusive and a complementary way. On the other hand, the split pattern J_K2*b* (illustrated in FIG. 12C) with a recording permission ratio of 0% is applied to the discharge port array 22K2*b*.

The split patterns J_K2*a*, J_K1, and J_K2*b* are applied in this way. This means that, in the forward scanning, the low-permeability black ink (K2) is not discharged from the discharge port array 22K2*b* to the black color edge portion, that the low-permeability black ink (K2) can be discharged from the discharge port array 22K2*a* to the black color edge portion with a recording permission ratio of about 50%, and that the high-permeability black ink (K1) can be discharged from the discharge port array 22K1 to the black color edge portion with a recording permission ratio of about 50%. Thus, in the forward scanning, it is possible to discharge the high-permeability black ink (K1) from the discharge port array 22K1 to the black color edge portion and discharge the low-permeability black ink (K2) from the discharge port array 22K2*a* to the black color edge portion in this order.

On the other hand, in the backward scanning according to the present exemplary embodiment, the black ink is discharged only from the discharge port arrays 22K1 and 22K2*b* to the black color edge portion. Therefore, in the backward scanning, the black data corresponding to the black color edge portion is distributed only to the discharge port arrays 22K1 and 22K2*b* among the discharge port arrays 22K2*a*, 22K1, and 22K2*b* illustrated in FIG. 2.

Therefore, in the backward scanning according to the present exemplary embodiment, the split patterns L_K1 and L_K2*b* (illustrated in FIGS. 12E and 12F, respectively) with a recording permission ratio of 50% for each are applied to the discharge port arrays 22K1 and 22K2*b*, respectively, for the black data corresponding to the black color edge portion. The split pattern L_K1 and L_K2*b* are designed so that the recording permitted pixels are arranged on an exclusive and a complementary way. On the other hand, the split pattern L_K2*a* (illustrated in FIG. 12D) with a recording permission ratio of 0% is applied to the discharge port array 22K2*a*.

The split patterns L_K2*a*, L_K1, and L_K2*b* are applied in this way. This means that, in the backward scanning, the low-permeability black ink (K2) is not discharged from the discharge port array 22K2*a* to the black color edge portion, that the low-permeability black ink (K2) can be discharged from the discharge port array 22K2*b* to the black color edge portion with a recording permission ratio of about 50%, and that the high-permeability black ink (K1) can be discharged from the discharge port array 22K1 to the black color edge portion with a recording permission ratio of about 50%. Thus, in the backward scanning, it is possible to discharge the high-permeability black ink (K1) from the discharge port array 22K1 to the black color edge portion and discharge the low-permeability black ink (K2) from the discharge port array 22K2*b* to the black color edge portion.

According to the present exemplary embodiment, as described above, it becomes possible to discharge the high-permeability black ink (K1) and the low-permeability black ink (K2) to the black color edge portion in this order. Therefore, the present exemplary embodiment can prevent the occurrence of the bleeding phenomenon more suitably than the first exemplary embodiment.

Similar to the second exemplary embodiment, a third exemplary embodiment performs recording by controlling the discharge order of the high-permeability black ink (K1) and the low-permeability black ink (K2) in addition to performing control according to the first exemplary embodiment. However, unlike the second exemplary embodiment, the present exemplary embodiment controls ink discharge so that the low-permeability black ink (K2) and the high-permeability black ink (K1) are discharged in this order.

Descriptions of elements similar to those in the first and the second exemplary embodiments will be omitted.

To improve the color density, the low-permeability black ink (K2) and the high-permeability black ink (K1) to the black color edge portion are to be discharged in this order.

If the high-permeability black ink (K1) is applied first to the recording medium, the low-permeability black ink (K2) and the high-permeability black ink (K1) immediately contact each other when the low-permeability black ink (K2) is subsequently applied to the recording medium. Then, the degradation in the surface tension of the low-permeability black ink (K2), i.e., the improvement in the permeability of the low-permeability black ink (K2), immediately occurs. As a result, color materials contained in the low-permeability black ink (K2) permeate the inside of the recording medium. This may lead to insufficient color density.

On the other hand, if the low-permeability black ink (K2) is applied first as in the present exemplary embodiment, the permeability remains low because only the low-permeability black ink (K2) exists in the black area until the high-permeability black ink (K1) is applied. Therefore, in this case, color materials are likely to remain on the surface of the recording medium, and thus ink can be fixed with sufficient color density.

Using the above-described different types of ink, the optical density of images recorded in the black area were measured through an experiment for the following three different cases: (1) The high-permeability black ink (K1) and the low-permeability black ink (K2) are discharged without controlling the discharge order, (2) The high-permeability black ink (K1) and the low-permeability black ink (K2) are discharged in this order, and (3) The low-permeability black ink (K2) and the high-permeability black ink (K1) are discharged in this order. Experimental results are described in Table 3. In recording, images under measurement were recorded by applying the high-permeability black ink (K1) and the low-permeability black ink (K2) to a predetermined area on a recording medium with a recording permission ratio of 50% for each, i.e., 100% in total. The optical density was measured by using the Spectrolino (from GretagMacbeth).

TABLE 3

| | Optical density |
|---|---|
| (1) Discharge order not controlled | 1.23 |
| (2) High-permeability and low-permeability black ink discharged in this order | 1.18 |
| (3) Low-permeability and high-permeability black ink discharged in this order | 1.29 |

As described in Table 3, it was confirmed that the case (3), "The low-permeability black ink (K2) and the high-permeability black ink (K1) are discharged in this order", between the three cases, provides a highest optical density of 1.29. It was also confirmed that the case (1), "The high-permeability black ink (K1) and the low-permeability black ink (K2) are discharged without controlling the discharge order", provides a higher optical density than the case (2), "The high-permeability black ink (K2) and the low-permeability black ink (K1) are discharged in this order".

In consideration of the above points, in the present exemplary embodiment, the low-permeability black ink (K2) and the high-permeability black ink (K1) are discharged to the black color edge portion in this order to record an image with a high optical density.

Figure 13A:
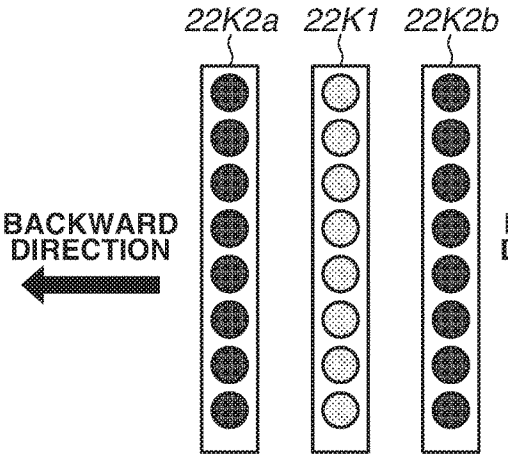
FIGS. 13A, 13B, and 13C illustrates the order of black ink discharge according to an exemplary embodiment.
Figure 13B:
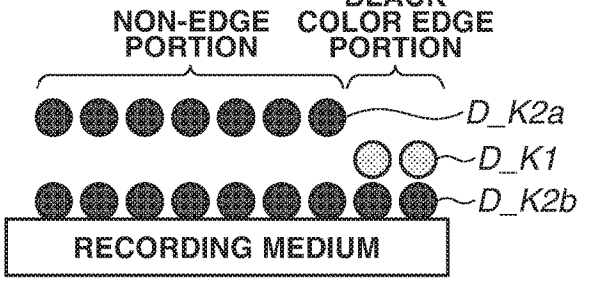
Figure 13C:
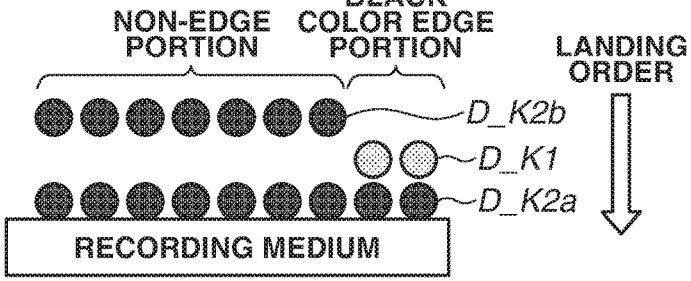

FIGS. 13A, 13B, and 13C illustrate the order of black ink discharge according to the present exemplary embodiment.

FIG. 13A illustrates the vicinity of the discharge port array 22K2*a* for the low-permeability black ink (K2), the discharge port array 22K1 for the high-permeability black ink (K1), and the discharge port array 22K2*b* for the low-permeability black ink (K2) of the recording head 9 illustrated in FIG. 2.

According to the present exemplary embodiment, an ink discharge operation is performed while the recording head 9 reciprocally moves in the X direction for scanning, the order of ink discharge from each discharge port array differs between the forward scanning (from left to right) and the backward scanning (from right to left). In the forward scanning, an ink droplet D_K2*b* is discharged from the discharge port array 22K2*b*, an ink droplet D_K1 is discharged from the discharge port array 22K1, and an ink droplet D_K2*a* is discharged from the discharge port array 22K2*a* in this order. In the backward scanning, an ink droplet D_K2*a* is discharged from the discharge port array 22K2*a*, an ink droplet D_K1 is discharged from the discharge port array 22K1, and an ink droplet D_K2*b* is discharged from the discharge port array 22K2*b* in this order.

Similar to the second exemplary embodiment, since the order of ink landing from each discharge port array depends on the scanning direction, the discharge port arrays to be used for ink discharge are differentiated for each scanning direction.

More specifically, in the forward scanning, ink is discharged from the discharge port arrays 22K1 and 22K2*b* to the black color edge portion. As illustrated in FIG. 13B, after applying the ink droplet D_K2*b* of the low-permeability black ink (K2) from the discharge port array 22K2*b* to the black color edge portion, the ink droplet D_K1 of the high-permeability black ink (K1) can be applied from the discharge port array 22K1 to the black color edge portion.

On the other hand, in the backward scanning, ink is discharged from the discharge port arrays 22K1 and 22K2*a* to the black color edge portion. As illustrated in FIG. 13C, after applying the ink droplet D_K2*a* of the low-permeability black ink (K2) from the discharge port array 22K2*a* to the black color edge portion, the ink droplet D_K1 of the high-permeability black ink (K1) can be applied from the discharge port array 22K1 to the black color edge portion.

According to the present exemplary embodiment, as described above, the discharge port arrays to be used for ink discharge are differentiated for each scanning direction. In both the forward scanning and the backward scanning, the low-permeability black ink (K2) and the high-permeability black ink (K1) are discharged to the black color edge portion in this order.

Similar to the second exemplary embodiment, the recording data generation processing is performed according to the flowchart illustrated in FIG. 11. However, the recording data generation processing according to the present exemplary embodiment differs from that according to the second exemplary embodiment in the split patterns used for the black color edge data split processing for the forward scanning in step S27_2 and the black color edge data split processing for the backward scanning in step S27_3.

According to the present exemplary embodiment, in the black color edge discharge port array split processing for the forward scanning, the split patterns L_K2*a*, L_K1, and L_K2*b* illustrated in FIGS. 12D, 12E, and 12F are applied to the discharge port arrays 22K2*a*, 22K1, and 22K2*b*, respectively. Therefore, in the forward scanning according to the present exemplary embodiment, the low-permeability black ink (K2) is not discharged from the discharge port array 22K2*a* to the black color edge portion, the low-permeability black ink (K2) is discharged from the discharge port array 22K2*b* to the black color edge portion with a recording permission ratio of about 50%, and the high-permeability black ink (K1) is discharged from the discharge port array 22K1 to the black color edge portion with a recording permission ratio of about 50%. Thus, in the forward scanning, it is possible to discharge the low-permeability black ink (K2) from the discharge port array 22K2*b* to the black color edge portion and discharge the high-permeability black ink (K1) from the discharge port array 22K1 to the black color edge portion in this order.

On the other hand, in the black color edge discharge port array split processing for the backward scanning, the split patterns J_K2*a*, J_K1, and J_K2*b* illustrated in FIGS. 12A, 12B, and 12C are applied to the discharge port arrays 22K2*a*, 22K1, and 22K2*b*, respectively. Therefore, in the backward scanning according to the present exemplary embodiment, the low-permeability black ink (K2) is not discharged from the discharge port array 22K2*b* to the black color edge portion, the low-permeability black ink (K2) is discharged from the discharge port array 22K2*a* to the black color edge portion with a recording permission ratio of about 50%, and the high-permeability black ink (K1) is discharged from the discharge port array 22K1 to the black color edge portion with a recording permission ratio of about 50%. Thus, in the backward scanning, it is possible to discharge the low-permeability black ink (K2) from the discharge port array 22K2*a* to the black color edge portion and discharge the high-permeability black ink (K1) from the discharge port array 22K1 to the black color edge portion in this order.

According to the present exemplary embodiment, as described above, it becomes possible to discharge the low-permeability black ink (K2) and the high-permeability black ink (K1) to the black color edge portion in this order. Therefore, the present exemplary embodiment can record an image with a higher color density than the first exemplary embodiment.

The second and the third exemplary embodiments have been described above centering on a configuration in which, using a recording head having the discharge port array 22K1 for the high-permeability black ink (K1) disposed between the two discharge port arrays 22K2*a* and 22K2*b* for the low-permeability black ink (K2), the discharge port arrays to be used for ink discharge are differentiated for each scanning direction. However, other forms of embodiment are also applicable. For example, even if a recording head having one discharge port array for the low-permeability black ink (K2) disposed between two discharge port arrays for the high-permeability black ink (K2) is used, differentiating the discharge port arrays for discharging ink for each scanning direction enables discharging ink in the discharge order according to the second and the third exemplary embodiments, achieving similar effects. When performing multi-pass recording, distributing data so that the ink to be discharged first corresponds to the first half pass and the ink to be discharged last corresponds to the last half pass enables acquiring similar effects to the second and the third exemplary embodiments.

The first to the third exemplary embodiments have been described above centering on a configuration in which the high-permeability black ink (K1) is discharged to the black color edge portion with a recording permission ratio of 50% and the low-permeability black ink (K2) is discharged to the black color edge portion with a recording permission ratio of 50%.

On the other hand, a fourth exemplary embodiment will be described below centering on a configuration in which the high-permeability black ink (K1) and the low-permeability black ink (K2) are used to record a plurality of test patterns with different recording permission ratios on the black color edge portion, and the recording permission ratio for each ink is determined based on the result of reading the test patterns.

Descriptions of elements similar to those in the first to the third exemplary embodiments will be omitted.

According to the present exemplary embodiment, a plurality of test patterns is recorded on the recording medium at a predetermined timing before recording. Table 4 describes the recording permission ratios of the high-permeability black ink (K1) and the low-permeability black ink (K2) when recording each test pattern.

TABLE 4

| | 1 | 2 | 3 | 4 | 5 | 6 | 7 | 8 |
|---|---|---|---|---|---|---|---|---|
| Recording permission ratio of high-permeability black ink (K1) | 90 | 80 | 70 | 60 | 50 | 40 | 30 | 20 |
| Recording permission ratio of low-permeability black ink (K2) | 10 | 20 | 30 | 40 | 50 | 60 | 70 | 80 |

Figure 14:
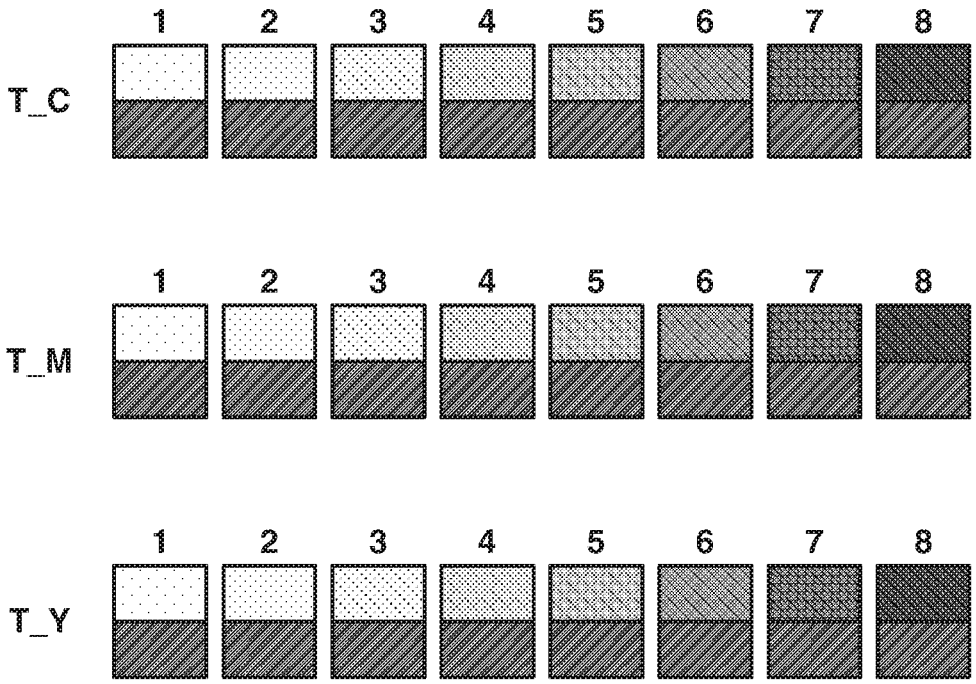
FIG. 14 is a schematic view illustrating recorded test patterns according to an exemplary embodiment.

FIG. 14 schematically illustrates test patterns to be recorded according to the present exemplary embodiment.

According to the present exemplary embodiment, three different test patterns are recorded as test patterns for the black color edge portion: a test pattern T_C for determining a black cyan edge where the black and cyan ink are applied to adjoining positions, a test pattern T_M for determining a black magenta edge where the black and magenta ink are applied to adjoining positions, and a test pattern T_Y for determining a black yellow edge where the black and yellow ink are applied to adjoining positions. Eight different patterns are recorded for each of the test patterns T_C, T_M, and T_Y. For the eight different patterns, the lower half is recorded by using each color ink with a recording permission ratio of 100%, and the upper half is recorded by using the high-permeability black ink (K1) and the low-permeability black ink (K2) with the recording permission ratios illustrated in Table 4.

After recording the test patterns T_C, T_M, and T_Y illustrated in FIG. 14, a user visually reads the test patterns and selects a pattern having the most desirable image quality for each of the test patterns T_C, T_M, and T_Y. The user inputs the result from a display provided on the host PC 312. Based on the selection result, the CPU 301 determines the recording permission ratios of the high-permeability black ink (K1) and the low-permeability black ink (K2) when recording the black color edge portion within the recording apparatus 100.

For example, when the user selects pattern "3" for each of the test patterns T_C, T_M, and T_Y, the CPU 301 performs recording on the black color edge portion by using the high-permeability black ink (K1) with a recording permission ratio of 70% and the low-permeability black ink (K2) with a recording permission ratio of 30%. For another example, when the user selects pattern "7" for the test pattern T_C, pattern "6" for the test pattern T_M, and pattern "5" for the test pattern T_Y, the CPU 301 performs recording on the black color edge portion by using the high-permeability black ink (K1) with a recording permission ratio of 40% and the low-permeability black ink (K2) with a recording permission ratio of 60%, taking the average of the these values.

Although, in the above-described case, the test patterns are determined through the user's viewing, test patterns may be determined based on the result of detection by a sensor for color measurement provided in the recording apparatus 100.

Other Embodiments

Embodiment(s) of the disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)), a flash memory device, a memory card, and the like.

Each exemplary embodiment has been described above centering on a configuration in which, regardless of the type of a recording medium, only the low-permeability black ink (K2) is discharged to the non-edge portion in the black area, and both the high-permeability black ink (K1) and the low-permeability black ink (K2) are discharged to the black color edge portion. However, other forms of embodiment are also applicable. Since the bleeding phenomenon notably occurs on a recording medium having high permeability, such as plain paper, the effect of each exemplary embodiment can be suitably acquired when recording is made on plain paper. Therefore, when recording is made on a recording medium other than plain paper, only the low-permeability black ink (K2) may be applied to the black color edge portion as in the case of the non-black color edge portion, instead of applying the present exemplary embodiment. The present exemplary embodiment may be applied when recording is made on plain paper.

Although each exemplary embodiment has been described above centering on a configuration in which the black data on the black color edge portion is split by using split patterns, other forms of embodiment are also applicable. For example, the black data on the black color edge portion may be split for each discharge port array in a state of multi-value data before being applied with the quantization processing.

The second exemplary embodiment has been described above centering on a configuration in which the high-permeability black ink (K1) and the low-permeability black ink (K2) are discharged to the black color edge in this order to prevent the bleeding phenomenon. The third exemplary embodiment has been described above centering on a configuration in which the low-permeability black ink (K2) and the high-permeability black ink (K1) are discharged in this order to improve the color density. On the other hand, when using the split patterns illustrated in FIGS. 9D to 9F according to the first exemplary embodiment, the low-permeability black ink (K2), the high-permeability black ink (K1), and the low-permeability black ink (K2) are discharged in this order for both the forward scanning and the backward scanning. Therefore, the effect of preventing the bleeding phenomenon according to the second exemplary embodiment and the effect of improving the color density according to the third exemplary embodiment can be acquired to some extent.

It is also possible to switch between a configuration in which the high-permeability black ink (K1) and the low-permeability black ink (K2) are discharged in this order as described in the second exemplary embodiment and a configuration in which the low-permeability black ink (K2) and the high-permeability black ink (K1) are discharged in this order as described in the third exemplary embodiment, depending on recording conditions such as the recording speed.

Although each exemplary embodiment has been described above centering on a configuration in which recording is made over the entire area of a recording medium while repeating the movement of the recording head and the conveyance of the recording medium, other forms of embodiment are also applicable. For example, using a recording head having a length equal to or longer than the width of a recording medium, recording may be performed over the entire area of the recording medium while scanning the recording medium only once in the direction intersecting with the direction of the discharge port arrays with respect to the fixed recording head.

Although a recording apparatus and a recording method based on the recording apparatus have been described in each exemplary embodiment, each exemplary embodiment is also applicable to an image processing apparatus or an image processing method for generating data for performing the recording method according to each exemplary embodiment. The exemplary embodiments are also applicable to a configuration in which a program for performing the recording method according to each exemplary embodiment is prepared in a unit different from the recording apparatus.

The recording apparatus according to the aspect of the embodiments makes it possible to perform recording with higher image quality by preventing the boundary between a color area and a black area from becoming ambiguous.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-205383, filed Oct. 19, 2016, which is hereby incorporated by reference herein in its entirety.

What is claimed is:

1. A recording apparatus comprising:

a recording head configured to discharge first black ink, second black ink having a higher surface tension than the first black ink, and color ink having a lower surface tension than the second black ink;

a determination unit configured to determine whether a target portion of a first area to be subjected to recording with a black ink on a recording medium is an edge portion adjoining a second area to be subjected to recording with at least the color ink; and a control unit configured to control a recording operation to record an image on the recording medium by discharging ink from the recording head, wherein the control unit controls the recording operation to discharge both the first and the second black ink to the target portion determined to be the edge portion.

2. The recording apparatus according to claim 1, wherein the control unit controls the recording operation to discharge the second black ink to the target portion determined to be a non-edge portion out of the first area.

3. The recording apparatus according to claim 2, wherein the target portion determined not to be the edge portion is an inside of the first area.

4. The recording apparatus according to claim 2, wherein the target portion determined not to be the edge portion is a second edge portion adjoining an area to be not subjected to image recording out of the first area.

5. The recording apparatus according to claim 1, wherein the control unit controls the recording operation so that the first and the second black ink are discharged in this order to the target portion determined to be the edge portion.

6. The recording apparatus according to claim 1, wherein the control unit controls the recording operation so that the second and the first black ink are discharged in this order to the target portion determined to be the edge portion.

7. The recording apparatus according to claim 1, wherein the control unit controls the recording operation so that the second, the first, and the second black ink are discharged in this order to the target portion determined to be the edge portion.

8. The recording apparatus according to claim 1, wherein the recording head has one discharge port array for discharging the first black ink and two discharge port arrays for discharging the second black ink, wherein the one discharge port array is disposed between the two discharge port arrays, and wherein the control unit controls the recording operation to discharge ink to the recording medium while the recording head reciprocally moves.

9. The recording apparatus according to claim 1, wherein a color of the color ink is cyan, magenta, or yellow.

10. The recording apparatus according to claim 1, wherein permeability of the second black ink over the recording medium is lower than permeability of the first black ink over the recording medium, and is lower than permeability of the color ink over the recording medium.

11. The recording apparatus according to claim 1, wherein a surface tension of the first black ink is 20 to 35 [mN/m], a surface tension of the second black ink is 35 to 50 [mN/m], and a surface tension of the color ink is 20 to 35 [mN/m].

12. The recording apparatus according to claim 1, wherein, (i) when recording is made on a first recording medium, the control unit controls the recording operation to discharge both the first and the second black ink to the target portion determined to be the edge portion, and wherein, (ii) when recording is made on a second recording medium different in type from the first recording medium, the control unit controls the recording operation to discharge the second black ink to the target portion determined to be the edge portion.

13. The recording apparatus according to claim 12, wherein the first recording medium is plain paper.

14. A recording apparatus comprising:

a recording head configured to discharge first black ink, second black ink having a higher surface tension than the first black ink, and color ink having a lower surface tension than the second black ink; and a control unit configured to control a recording operation to record an image on a recording medium by discharging ink from the recording head, wherein the control unit performs the recording operation (i) to discharge both the first and the second black ink to an edge portion adjoining a second area to be subjected to recording with at least the color ink out of a first area to be subjected to recording with a black ink on the recording medium, and (ii) to discharge the second black ink to an area different from the edge portion out of the first area.

15. The recording apparatus according to claim 14, wherein the area different from the edge portion out of the first area is an inside of the first area.

16. The recording apparatus according to claim 14, wherein the area different from the edge portion out of the first area is a second edge portion adjoining an area to be not subjected to image recording out of the first area.

17. The recording apparatus according to claim 14, wherein the control unit controls the recording operation so that the first and the second black ink are discharged in this order to the area different from the edge portion out of the first area.

18. The recording apparatus according to claim 14, wherein permeability of the second black ink over the recording medium is lower than permeability of the first black ink over the recording medium, and is lower than permeability of the color ink over the recording medium.

19. A recording method for recording an image by using a recording head for discharging first black ink, second black ink having a higher surface tension than the first black ink, and color ink having a lower surface tension than the second black ink, the recording method comprising:

determining whether a target portion of a first area to be subjected to recording with a black ink on a recording medium is an edge portion adjoining a second area to be subjected to recording with at least the color ink; and controlling a recording operation to record an image on the recording medium by discharging ink from the recording head, wherein the recording operation is controlled in the controlling to discharge both the first and the second black ink to the target portion determined to be the edge portion.

20. A recording method for recording an image by using a recording head for discharging first black ink, second black ink having a higher surface tension than the first black ink, and color ink having a lower surface tension than the second black ink, the recording method comprising:

controlling a recording operation to record an image on the recording medium by discharging ink from the recording head, wherein in the controlling, the recording operation is performed (i) to discharge both the first and the second black ink to an edge portion adjoining a second area to be subjected to recording with at least the color ink out of a first area to be subjected to recording with a black ink on the recording medium, and (ii) to discharge the second black ink to an area different from the edge portion out of the first area.

* * * * *